United States Patent [19]

Burgess et al.

[11] 4,211,216

[45] Jul. 8, 1980

[54] WHIRLPOOL BATH

[75] Inventors: John D. Burgess, Loretto; Virgil J. Jacuzzi, Islington, both of Canada

[73] Assignee: Jacuzzi Bros., Incorporated, Little Rock, Ark.

[21] Appl. No.: 958,333

[22] Filed: Nov. 7, 1978

[51] Int. Cl.[2] ..... A61H 9/00

[52] U.S. Cl. ..... 128/66; 5/81 R

[58] Field of Search ..... 128/66, 369; 4/173 M, 4/173 R; 5/81 R, 83; 4/178, 180

[56] References Cited

U.S. PATENT DOCUMENTS

| | | | |
|---|---|---|---|
| 2,419,801 | 4/1947 | Uphues | 4/173 |
| 2,510,933 | 6/1950 | Roach | 4/173 |
| 3,641,996 | 2/1972 | Friend | 128/66 |
| 3,736,924 | 6/1973 | Jacuzzi et al. | 128/66 |

FOREIGN PATENT DOCUMENTS

| | | | |
|---|---|---|---|
| 1376762 | 9/1964 | France | 4/173 |

*Primary Examiner*—Lawrence W. Trapp

*Attorney, Agent, or Firm*—Hill, Van Santen, Steadman, Chiara & Simpson

[57] ABSTRACT

A whirlpool bath designed for use in hospitals and similar institutions has a tub which is raised sufficiently above the floor level on a recessed steel base so as to allow a vertical clearance for the use of trolleys and mobile patient-handling equipment to move patients toward and lower patients into the whirlpool bath. The recess also makes work around the tub easier for attendants, providing toe room allowing the attendants to move closer to the tub. Bumper strips and base moldings are attached to the whirlpool bath to protect the bath from damage from movable patient-handling equipment. The sides and ends of the tub have removable panels fitting under the rim of the tub and clipping to a steel frame for rapid and easy removal and replacement. A capped opening in the built-in plumbing allows the water supply from a wall-mounted mixing valve to be admitted directly to the tub through the whirlpool fittings as an alternative to a spout or hose.

12 Claims, 5 Drawing Figures

WHIRLPOOL BATH

BACKGROUND OF THE INVENTION

1. Field of the Invention

This invention relates to hydrotherapy devices, specifically to whirlpool baths.

2. Description of the Prior Art

The action of an air and water mixture over the body is known to have a massaging and soothing effect and a method of patient treatment known as hydrotherapy has developed utilizing this principle. Treatment utilizing hydro-massage eases the symptoms of hypertension and stress, and is also excellent in the treatment of arthritis and rheumatism because of the beneficial effects of increasing circulation and reducing muscle spasm and pain. Experience also shows that the patient benefits psychologically in that the patient's sense of well-being invariably increases with whirlpool hydrotherapy. Aside from its therapeutic benefits, a whirlpool bath also performs equally well as a patient bathing unit.

Whirlpool tubs have thus gained widespread use in hospital and other similar institutions. Most of such whirlpool units are, however, stock models which are suitable for use in many other environments other then the hospital environment. Such whirlpool baths are thus not specifically designed for use with hospital or institutional patient-handling equipment. Because such whirlpool units are non-customized for hospital use, patient transfer from patient-handling devices to the whirlpool bath may be quite awkward, and in some cases impossible.

SUMMARY OF THE INVENTION

In accordance with this invention there is provided a whirlpool bath specifically designed for use with hospital or similar institutional patient-handling devices, wherein repair time is reduced by providing a whirlpool bath with removable side and end panels providing easy access to the built-in circulating pump and plumbing. An opening in the built-in plumbing allows a water supply from a wall-mounted mixing valve to be admitted directly to the tub through the whirlpool fittings as an alternative to use of a spout or hose.

Further, according to the invention, the tub is raised above the floor level and rests on a recessed steel base. The steel base can be anchored to the floor and wall and provide additional height and toe room making work around the tub easier for attendants. The vertical clearance provided by the recessed steel base also provides a channel beneath the tub allowing patient-handling equipment to be moved directly over the tub with the base of the patient handling device moving in the recessed channel. The tub itself is formed of molded fiberglass, or other suitable material, and is supported by a generally box-like frame consisting of L-members. The entire tub structure rests on the recessed steel base by means of a plurality of I-beams which traverse the shorter dimension of the steel base.

A circulating pump is disposed beneath the tub, but contained inside the L-member frame and side panels of the supporting structure are easily removable for access to the pump and plumbing system. The panels fit under the specially designed rim of the tub and clip to the steel frame for rapid removal.

Bumper strips are attached to the frame at one end of the tub to cushion impact with mobile patient-handling equipment.

Although the tub may be filled with water from a conventional spout or hose, the invention is provided with a capped opening in the built-in plumbing which allows a water supply from a wall-mounted mixing valve to be admitted directly to the tub through the whirlpool fittings.

DESCRIPTION OF THE PREFERRED EMBODIMENTS

Figure 1:
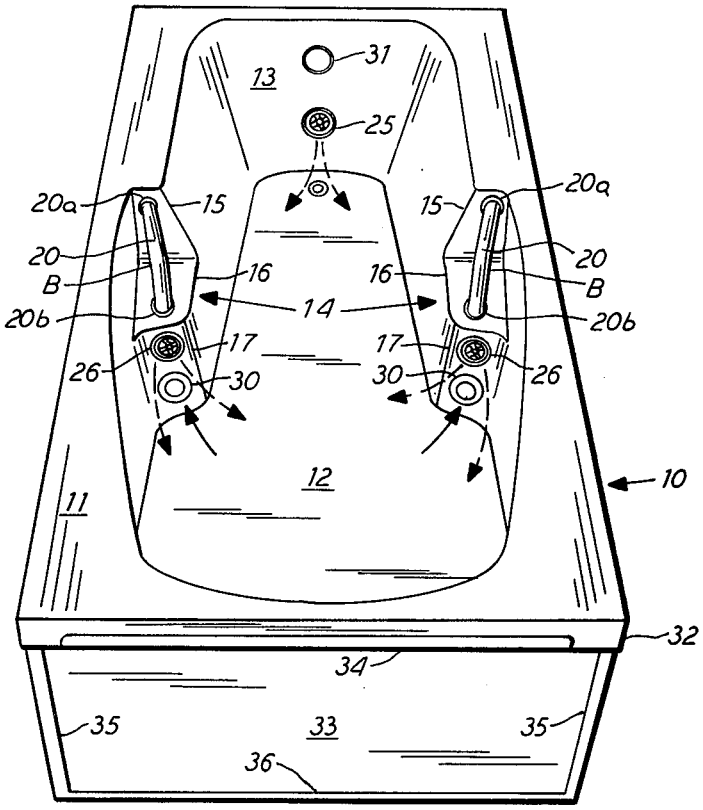
FIG. 1 is a perspective view of an empty whirlpool bath.

A whirlpool tub having the customized features of this invention allowing use with mobile patient-handling equipment is generally indicated at 10 in FIG. 1. The tub itself consists of a one-piece molded fiberglass portion, shown generally as 18 in FIG. 3. The fiberglass 18 consists of a top flat portion 11, generally parallel to the floor, and a depression formed by a substantially flat base 12 and a continuous side wall 13.

The tub 18 is provided with arm rests 14 on either side for comfort and safety. The arm rests 14 each consist of a generally upright portion 15, a flat portion 16 generally at a right angle to upright portion 15 and parallel to the base 12, and a second generally upright portion 17 disposed between the arm rest flat portion 16 and the base 12. A hollow tube 20 having a right angle bend B is connected at one end 20A to upright portion 15 of the arm rest 14 and at its other end 20B to the flat portion 16 of the arm rest 14. The tube 20 may be of stainless steel or other suitable material, and provides a place to grip while lowering or raising oneself into or out of the tub 18. The hollow tubes 20 and the arm rests 14 also provide a stabilizing means for the user while sitting in the tub 18.

The tub 18 is provided with three whirlpool outlet ports or jet ports. An outlet port 26 is disposed on the upper portion of each of arm rest upright portions 17, and a third outlet port 25 is disposed on tub wall 13 at a portion of the tub 18 closest to the wall 21.

Two inlet ports 30 are disposed on the lower portion of each of arm rest upright portions 17. When the tub is filled with water, operation of the ports results in an air and water mixture emerging from each of outlet ports 26 and 25, and water is sucked into the inlet ports 30 for recirculation and remixture with air for reentry into the tub 18 via the outlet ports 26 and 25.

The tub 18 may be filled with water from a conventional spout 22 controlled by a supply line faucet 23. A stabilization bar 24 may also be attached to the wall 21 to provide additional support and safety, and also serve as a towel rack.

Figure 4:
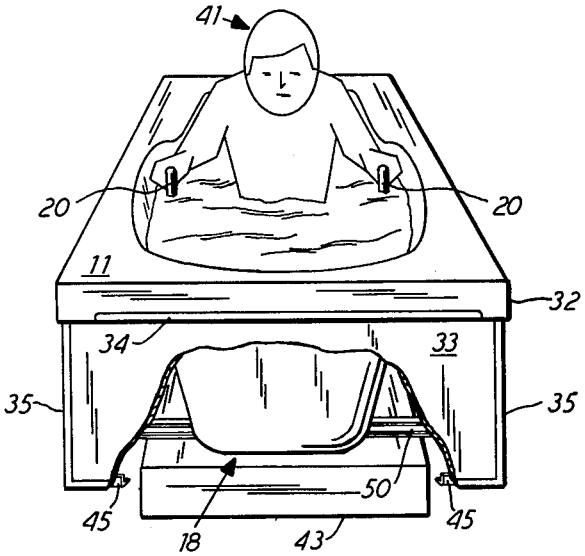
FIG. 4 is a partially cut-away perspective view of the whirlpool bath showing use by a patient holding the handrails.

As shown in FIG. 4, the tub 18 is supported by a generally box-like rectangular frame comprised of steel L-members 45. The L-members 45 form the perimeter of each of the sides of the whirlpool bath 10 and hold removable end panel 33 and removable side panels 44 in place to cover the lower portion of the whirlpool bath 10.

A stainless steel supporting base 43 is disposed beneath the whirlpool bath 10. The base 43 is also of a rectangular shape, but has dimensions on each side which are smaller than the dimensions of the frame 45. A recess is thus provided beneath the whirlpool bath 10 on the two sides and the end thereof. The size of the channels may be varied as specific needs may dictate, however, a generally useful recess provides a vertical clearance of approximately 8-¾ inches (22.145 cm).

Figure 2:
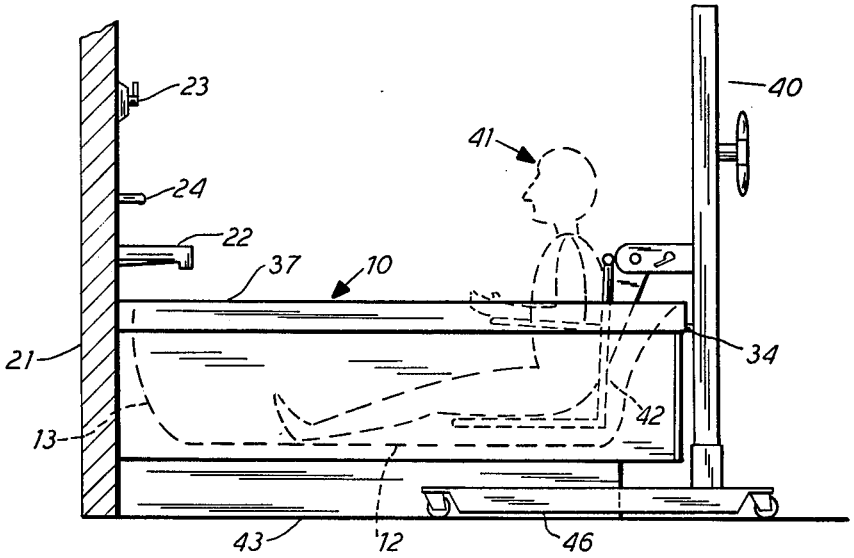
FIG. 2 is a side elevational view of the whirlpool bath and a patient-handling device showing a patient lowered into the tub.
Figure 5:
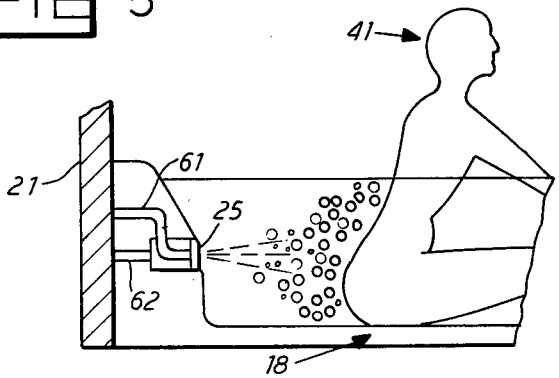
FIG. 5 is a simplified schematic diagram showing the massage action of the whirlpool bath on a patient.

Such a recess provides enough space for most hospital patient-handling equipment, such as the device shown in FIG. 2 as 40. The patient-handling device 40 has a base 46 on wheels or rollers which can move in the recess formed beneath the whirlpool bath 10, allowing the seat portion 42 of the device 40 to be positioned directly over the whirlpool bath 10. The patient 41 can thus be easily lowered directly into the tub 18 without disembarking from the patient-handling device 40. The patient can be placed in the whirlpool bath 10 as shown in FIG. 2, or, if able, may be moved about to the position shown in FIG. 4. The action of the whirlpool nozzles on the patient 41 is generally depicted in FIG. 5. The whirlpool outlet port 25 is connected to an air supply line 61 and a water supply line 62. The outlet port 25 contains apparatus for mixing the air and water and ejecting same by action of the pump 60, shown in FIG. 3. The massaging effect of the air bubbles emerging from the whirlpool outlet port 25 is shown in FIG. 5.

As shown in FIG. 4, the end of the whirlpool bath 10 farthest away from the wall 21 is provided with a number of bumper strips to cushion any impact with patient-handling equipment which might occur. A bumper strip 34 is carried on an end portion 32 of the molded fiberglass form which extends over the frame 45. Similar bumpers are carried on the portions of the end frame 45, such as generally upright bumpers 35 carried on either side, and a lower bumper 36 carried on the bottom of the frame 45.

Because the pump 60 and plumbing apparatus are disposed beneath the top portion 11 of the whirlpool bath 10, and are covered by the side panels 44 and an end panel 33, the panels must be removable to provide access to the pump and plumbing should repairs be needed. The end panel 33 and the side panels 44 are thus designed to slide underneath the end rim 32 and the side rims 37 of the molded fiberglass form. The side panels 44 and end panels 33 are held in place by means of clips carried on the insides of L-shaped frame members 45.

Figure 3:
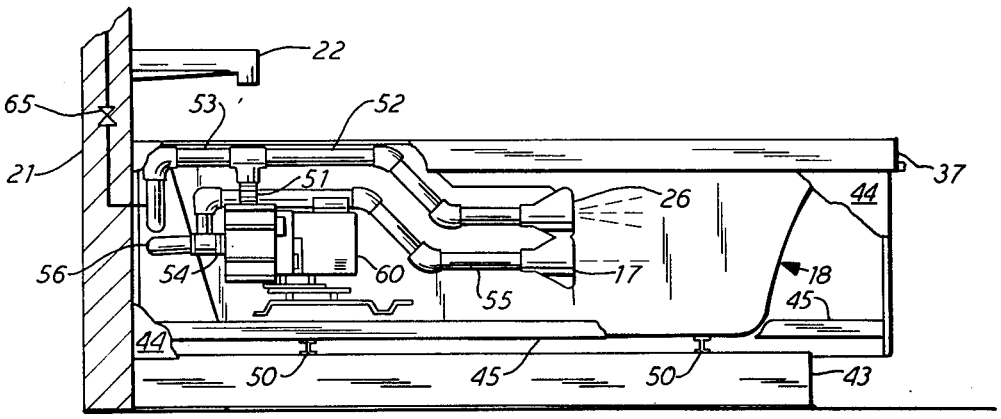
FIG. 3 is a side cut-away view of the whirlpool bath.

FIG. 3 shows one side of the whirlpool bath 10 as it appears when a side panel 44 has been removed. The pump 60 has an outlet port 51 which connects to a flow pipe 52 for transporting air and water to whirlpool outlet port 26 on the near side, and also connects to flow pipe 52 which transports air and water to whirlpool outlet port 25 and whirlpool outlet port 26 on the far side of the tub. The pump 60 has an inlet port 54 which draws water from the inlet port 17 on the near side through flow pipe 55, and from the outlet port 17 on the far side through flow pipe 56.

A direct line water supply may be connected to the outlet ports 26 to allow filling of the tub 18 with water, not mixed with air, as an alternative to use of a separate spout or hose. This is shown schematically in FIG. 3 with a valve 65 disposed between outlet port flow pipe 52 and a domestic water supply. The outlet ports 26 can be directionally rotated in a full circle, through a 30° angle, enabling the jets for effecting hydro-massage action to be directed to different areas of the body, as well as allowing for independent water flow adjustment.

The whirlpool inlet ports 17 are each provided with anti-vortex covers and hair and lint screens to eliminate the possibility of patient injury.

A timer switch may also be included with whirlpool bath 10 to insure that individual patients receive proper and exact hydro-massage exposure.

Although various minor modifications may be suggested by those versed in the art, it should be understood that I wish to embody within the scope of the patent warranted hereon all such embodiments as reasonably and properly come within the scope of my contribution to the art.

We claim as our invention:

1. In a whirlpool bath comprising:

a tub having a base, sides, and a rim;

a frame supporting said tub;

a circulating pump;

outlet port means connected to said pump and disposed in said sides of said tub to expel a mixture of air and water into said tub in the form of a hydrotherapeutic jet;

inlet port means connected to said pump through which water from said tub is returned to said pump for recirculation;

the improvements of:

a base disposed beneath said frame elevating said tub and having dimensions on all sides less than said frame such that a continuous U-shaped recess is formed between said frame and a floor for accommodating patient care and for receiving patient handling accessories to allow the accessories to be moved adjacent said frame.

2. The improvement of claim 1 including a plurality of bumper cushions disposed on an outer portion of said frame for cushioning said accessories used in association with the tub.

3. The improvement of claim 1 including a plurality of panels and removable clip means for fastening said panels to the inside of said frame and removably fitted beneath said rim of said tub.

4. The improvement of claim 1 including a valved conduit means connected between said pump and a domestic supply of water through which a charge of water may be admitted directly to said tub.

5. In a whirlpool bath comprising:

a tub having a base, sides, and a rim;

a frame supporting said tub;

a circulating pump;

outlet port means connected to said pump and disposed in said sides of said tub to expel a a mixture of air and water into said tub in the form of a hydrotherapeutic jet;

inlet port means connected to said pump through which water from said tub is returned to said pump for recirculation;

the improvement of:

a pair of arm rests each having an upright portion and a flat portion carried on said sides of said tub and disposed below said rim of said tub; and a right angle handrail carried on said arm rests with a first end of said handrail attached to said upright portion of each said arm rest and a second end of said handrail connected to said flat portion of each said arm rest.

6. In a whirlpool bath comprising:

a tub having a base, sides, and a rim;

a rectangular box frame supporting said tub;

a circulating pump;

a plurality of outlet ports connected to said pump and disposed in said sides of said tub, jet means in said outlet port to expel a mixture of air and water into said tub in the form of a hydrotherapeutic jet;

a plurality of inlet ports connected to said pump and disposed in said sides of said tub through which water from said tub is returned to said pump for recirculation;

the improvement of:

a rectangular base disposed beneath said rectangular box frame elevating said tub and having dimensions on all sides less than said frame such that a recess is formed between said frame and a floor for accommodating patient care;

a plurality of bumper cushions carried on one outer end of said rectangular frame for cushioning accessories used in association with the tub;

a plurality of panels, removable clip means for fastening said panels to the inside of said rectangular frame and removably fitted beneath said rim of said tub;

valved conduit means connected between said pump and a domestic supply of water through which a charge of water may be admitted directly to said tub; and a pair of arm rests each having an upright portion and a flat portion carried on said sides of said tub and disposed below said rim of said tub.

7. The combination of claim 6 wherein a right angle handrail is carried on said arm rests with a first end of said handrail attached to said upright portion of each said arm rest and a second end of said handrail connected to said flat portion of each said arm rest.

8. The combination of claim 6 wherein at least one of said outlet ports is disposed beneath each said handrail on an upright portion of each of said arm rests.

9. The combination of claim 6 wherein at least one of said outlet ports is disposed in a side of said tub which is opposite a side of said tub which is closest to said bumper cushions.

10. The combination of claim 6 wherein at least one of said inlet ports is disposed beneath each said handrail on an upright portion of each of said arm rests.

11. In a whirlpool bath comprising:

a tub having a base, sides, and a rim;

a frame supporting said tub;

a circulating pump;

outlet port means connected to said pump and disposed in said sides of said tub to expel a mixture of air and water into said tub in the form of a hydrotherapeutic jet;

inlet port means connected to said pump through which water from said tub is returned to said pump for recirculation;

the improvement of a rectangular base disposed beneath said rectangular box frame elevating said tub and having dimensions on all sides less than said frame such that a recess is formed between said frame and a floor for accommodating patient care;

a plurality of bumper cushions carried on one outer end of said rectangular frame for cushioning accessories used in association with the tub;

a plurality of panels, removable clip means for fastening said panels to the inside of said rectangular frame and removably fitted beneath said rim of said tub;

valved conduit means connected between said pump and a domestic supply of water through which a charge of water may be admitted directly to said tub; and a pair of arm rests each having an upright portion and a flat portion carried on said sides of said tub and disposed below said rim of said tub.

12. For use in combination with a patient handling apparatus of the type having a U-shaped dirigible dolly having a lower bight portion, a therapeutic hydromassage tub having walls with hydromassage heads fixed therein to project jets of water and air into the tub for hydromassage of an occupant of the tub;

pump and conduit means connected to said hydromassage heads to furnish a supply of water and air thereto; and a platform subjacent said tub in support thereof, said platform having a depth sufficient to elevate the tub above a support surface so that the dolly will be received thereunder as well as the feet of attending personnel, said platform having a width such that said platform will fit into said bight portion of said U-shaped dolly, and said platform having a length less than the length of said tub.

* * * * *